US009982891B2

(12) United States Patent
Widenhorn et al.

(10) Patent No.: US 9,982,891 B2
(45) Date of Patent: May 29, 2018

(54) BURNERS HAVING FUEL PLENUMS

(71) Applicants: Dürr Systems AG, Bietigheim-Bissingen (DE); Deutsches Zentrum für Luft-und Raumfahrt e.V., Köln (DE)

(72) Inventors: Axel Widenhorn, Stuttgart (DE); Roland Stoll, Pforzheim (DE); Dominik Lebküchner, Esslingen (DE); Thilo Kissel, Bietigheim-Bissingen (DE); Jan Zanger, Calw (DE); Timo Zornek, Stuttgart (DE); Thomas Monz, Schlierbach (DE)

(73) Assignees: Dürr Systems AG, Bietigheim-Bissingen (DE); Deutsches Zentrum Für Luft-Und Raumfahrt E.V., Köln (DE)

( * ) Notice: Subject to any disclaimer, the term of this patent is extended or adjusted under 35 U.S.C. 154(b) by 395 days.

(21) Appl. No.: 14/563,532

(22) Filed: Dec. 8, 2014

(65) Prior Publication Data

US 2015/0089954 A1 Apr. 2, 2015

Related U.S. Application Data

(63) Continuation-in-part of application No. PCT/EP2013/066943, filed on Aug. 13, 2013.

(30) Foreign Application Priority Data

Aug. 17, 2012 (DE) ..... 10 2012 214 707
Sep. 11, 2012 (DE) ..... 10 2012 216 080

(51) Int. Cl.
*F23R 3/28* (2006.01)
*F23R 3/34* (2006.01)
*F23R 3/54* (2006.01)

(52) U.S. Cl.
CPC ..... *F23R 3/286* (2013.01); *F23R 3/283* (2013.01); *F23R 3/343* (2013.01); *F23R 3/54* (2013.01); *F23R 2900/03282* (2013.01)

(58) Field of Classification Search
CPC .. F02C 7/20; F02C 7/222; F23R 3/283; F23R 3/286; F23R 3/343; F23R 3/54; F23R 3/60; F23D 17/002
See application file for complete search history.

(56) References Cited

U.S. PATENT DOCUMENTS 2,786,371 A * 3/1957 Dawson ..... F23R 3/60 269/52
4,257,763 A * 3/1981 Reed ..... F23C 6/047 431/174

(Continued)

FOREIGN PATENT DOCUMENTS

DE 102008037480 4/2009
DE 102012216080 2/2014

(Continued)

OTHER PUBLICATIONS

Patent Cooperation Treaty, English version of "International Search Report", issued in connection with PCT No. PCT/EP2013/066943, dated Apr. 15, 2014, 2 pages.

(Continued)

*Primary Examiner* — Gerald L Sung
*Assistant Examiner* — Rene Ford
(74) *Attorney, Agent, or Firm* — Hanley, Flight and Zimmerman, LLC

(57) ABSTRACT

Burners having a fuel plenum in a base are disclosed. One disclosed example apparatus includes a base of a burner, the base comprising a fuel plenum and coupled to fuel nozzles, where at least one of the fuel nozzles is in fluid communication with the fuel plenum. The disclosed example apparatus also includes a burner head of the burner comprising (Continued)

nozzle passages in fluid communication with an airflow path, where the burner head defines a pilot combustion space that opens towards a flame tube of the burner, and is in fluid communication with the airflow path, and where each nozzle passage is to receive a fuel nozzle to provide fuel to entrain with air from the airflow path.

28 Claims, 5 Drawing Sheets

(56) References Cited

U.S. PATENT DOCUMENTS

| | | | | | |
|---|---|---|---|---|---|
| 5,323,614 | A * | 6/1994 | Tsukahara | F23R 3/34 | 60/737 |
| 5,415,000 | A * | 5/1995 | Mumford | F23R 3/60 | 60/740 |
| 5,816,050 | A * | 10/1998 | Sjunnesson | F23R 3/14 | 60/732 |
| 5,983,642 | A * | 11/1999 | Parker | F02C 7/222 | 239/403 |
| 6,148,604 | A * | 11/2000 | Salt | F01D 9/023 | 60/39.37 |
| 6,216,442 | B1 * | 4/2001 | Belsom | F02C 7/20 | 60/752 |
| 6,256,995 | B1 * | 7/2001 | Sampath | F23D 11/36 | 60/740 |
| 7,143,583 | B2 * | 12/2006 | Hayashi | F23R 3/18 | 60/737 |
| 8,020,385 | B2 * | 9/2011 | Popovic | F23R 3/005 | 165/169 |
| 2004/0211186 | A1 * | 10/2004 | Stuttaford | F23R 3/14 | 60/737 |
| 2009/0111063 | A1 * | 4/2009 | Boardman | F23R 3/14 | 431/8 |
| 2010/0139238 | A1 * | 6/2010 | Hall | F23R 3/283 | 60/39.463 |
| 2012/0047897 | A1 | 3/2012 | Hirata et al. | | |
| 2012/0192568 | A1 | 8/2012 | Miura et al. | | |
| 2013/0122438 | A1 * | 5/2013 | Stoia | F23R 3/286 | 431/144 |
| 2013/0167539 | A1 * | 7/2013 | Berry | F23R 3/286 | 60/737 |

FOREIGN PATENT DOCUMENTS

| | | | | |
|---|---|---|---|---|
| EP | 1103767 | | 5/2001 | |
| EP | 1985926 | | 10/2008 | |
| EP | 2213944 | | 8/2010 | |
| EP | 2362141 | | 8/2011 | |
| GB | 656012 | A * | 8/1951 | F23R 3/60 |
| JP | 2011191046 | | 9/2011 | |
| WO | 2014027005 | | 2/2014 | |

OTHER PUBLICATIONS

Patent Cooperation Treaty, "Written Opinion", issued in connection with PCT Application No. PCT/EP2013/066943, dated Apr. 15, 2014, 9 pages.

German Patent Office, "Search Report", issued in connection with German Application No. 10 2012 216 080, dated Apr. 23, 2013, 5 pages.

Patent Cooperation Treaty, English version of "International Preliminary Report on Patentability", issued in connection with PCT Application No. PCT/EP2013/066943, dated Feb. 17, 2015, 15 pages.

European Patent Office, German version of "Examination Report", issued in connection with European Application No. 13750036.9, dated Apr. 6, 2017 (6 pages).

* cited by examiner

BURNERS HAVING FUEL PLENUMS

RELATED APPLICATIONS

This patent arises as a continuation-in-part of International Patent Application No. PCT/EP2013/066943, which was filed on Aug. 13, 2013, which claims priority to German Patent Application No. 10 2012 216 080, which was filed on Sep. 11, 2012, which claims priority to German Patent Application No. 10 2012 214 707, which was filed on Aug. 17, 2012. The foregoing International Patent Application and the German Patent Applications are hereby incorporated herein by reference in their entireties.

FIELD OF THE DISCLOSURE

This disclosure relates generally to burners, and, more particularly, to burners having fuel plenums.

BACKGROUND

Burners are typically used for operating micro-gas turbines. These burners have a burner head that typically includes four to twenty nozzle passages including fuel nozzles positioned within and coupled to a burner-flange base. In a rear portion that faces away from a burner head, the fuel nozzles typically pass through holes of the burner-flange base. Such fuel nozzles usually have connecting devices for hose-form or pipe-form fuel lines that are connected to a fuel distribution ring positioned outside the burner. In order to ensure that minimal or no leakages occur in such burners, elaborate sealing of the fuel nozzles with respect to the burner-flange base is required, thereby resulting in high production and/or assembly costs.

Figure 1:
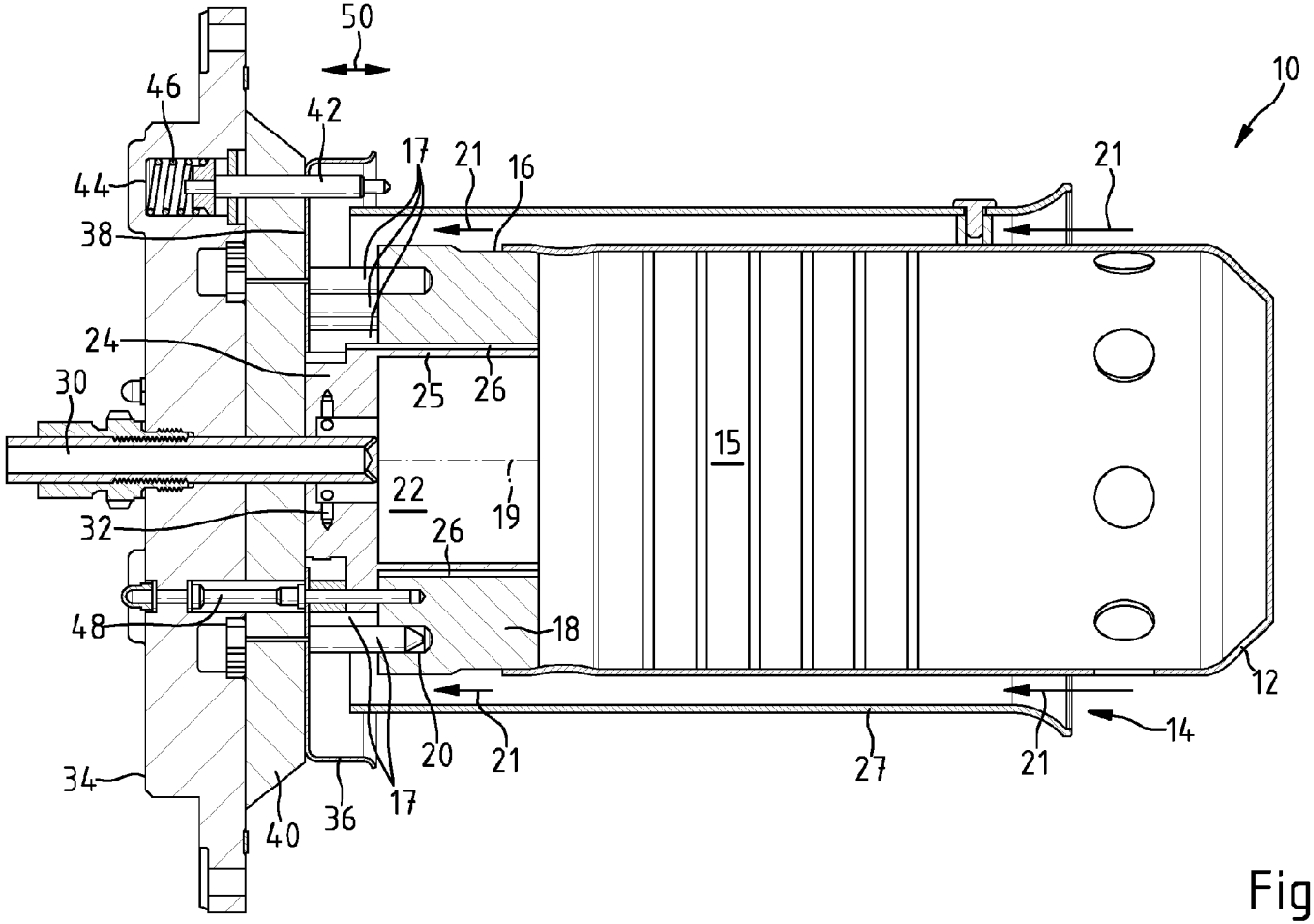
FIG. 1 illustrates a cross-sectional view of an example burner to produce heated gas.

The figures are not to scale. Instead, to clarify multiple layers and regions, the thicknesses of the layers may be enlarged in the drawings. Wherever possible, the same reference numbers will be used throughout the drawing(s) and accompanying written description to refer to the same or similar parts. As used in this patent, stating that any part (e.g., a layer, film, area, or plate) is in any way positioned on (e.g., positioned on, located on, disposed on, or formed on, etc.) another part, means that the referenced part is either in contact with the other part, or that the referenced part is above the other part with one or more intermediate part(s) located therebetween. Stating that any part is in contact with another part means that there is no intermediate part between the two parts.

DETAILED DESCRIPTION

The examples disclosed herein relate to a burner to produce heated gas (e.g., hot gas) using a flame tube, which can be coupled (e.g., connected, fluidly coupled, etc.) to a turbine and positioned in an air guiding device that encloses the flame tube and forms a flow path for air, and a burner head, which is fastened on a base to provide fuel mixed with air into the flame tube and has a plurality of nozzle passages in fluid communication with the flow path of air in the air guiding device and into which a fuel nozzle fastened on the base projects.

FIG. 1 illustrates a cross-sectional view of an example burner 10 to produce heated gas (e.g., hot gas). The burner 10 of the illustrated example has a flame tube 12 that is positioned in an air guiding device 14 and enclosing and/or defining a combustion space 15. In this example, the air guiding device 14 of the burner 10 is coupled to (e.g., fastened on) a base 34, which functions as a burner flange. To provide fuel mixed with air into the flame tube 12, the burner 10 includes a burner head 16, which is shaped as a substantially hollow cylinder having an axis (e.g., a central axis) 19 and a plurality of nozzle passages 20 formed and/or located in the cylinder wall in an azimuthally offset arrangement in relation to one another and having a through-bore that is substantially parallel to the axis 19. The nozzle passages 20 open into and/or are fluidly coupled to the combustion space 15. A fuel nozzle 17 of the illustrated example projects into the nozzle passages 20. In this example, the flame tube 12 fits over the burner head 16 and inner side butts of the flame tube 12 contact a portion of the outer side of the burner head 16 that acts as a guide (e.g., a guide section) of the flame tube 12. The flame tube 12 is guided in a generally linearly movable manner along the burner head 16 in a general direction defined by the axis 19 to enable and/or compensate for thermal expansion of the flame tube 12 during operation of the burner 10, for example.

The burner 10 of the illustrated example has flow paths 21 for air from the air guiding device 14 that may be provided via the nozzle passages 20 of the burner head 16 into the combustion space 15. In the nozzle passages 20, the air that is provided from the rear via the air guiding device 14 flows around the fuel nozzle 17 and envelops the gaseous or liquid fuel, which, in this example, is injected by the fuel nozzle 17 in a generally coaxial direction into the nozzle passages 20. In this example, the flow paths 21 for air are guided by an outer surface of the burner-head body 18 to cool the burner head 16 during operation of the burner 10 as air flows along the flow paths 21.

In this example, the air-fuel mixture is premixed in a relatively swirl-free manner and/or has reduced swirls within the nozzle passages 20. The air-fuel mixture of the illustrated example then flows from the nozzle passages 20 with a relatively high impulse into the combustion space 15. The air-fuel jet that enters the combustion space 15 of the illustrated example drives and/or produces a pronounced inner recirculation zone within the combustion space to ensure effective mixing of recirculated exhaust gas and fresh gas within the combustion space 15. In addition to this positive effect upon the stabilization of the flame, mixing of the exhaust gas slows down and/or reduces the chemical reaction rates. Consequently, the chemical reactions are then distributed over a larger volume. The chemically-kinetically controlled volumetric combustion of the illustrated example may therefore result in a substantially homogeneous temperature field that is relatively close to the adiabatic temperature of the global equivalence condition. As a result of the avoidance of temperature spikes associated therewith, relatively low $NO_x$ emissions may be achieved by the burner 10.

The burner 10 of the illustrated example has a pilot combustion space 22, which is located in a set-back position relative to the combustion space 15. The pilot combustion space 22 is defined by an insert 24. In this example, the insert 24 has a pilot dome wall 25, which acts as a combustion space wall and a wall surface, which delimits the pilot combustion space 22 and extends into the cavity of the body 18 of the burner head 16. In this example, air flow passages 26 are located between the pilot dome wall 25 and the burner head 16, and are in fluid communication with the air guiding device 14. As a result of the airflow, which is provided into the air flow passages 26 via the air guiding device 14, convectively cooling the pilot dome wall 25, which encloses the pilot combustion space 22, may be possible.

In this example, the burner 10 includes a pilot fuel nozzle 30, which is coaxially positioned relative to the burner head 16 and through which the pilot combustion space 22 can be provided with fuel that is combusted with air entering via flow passages 32, which are in fluid communication with the air guiding device 14. In some examples, the pilot fuel nozzle 30 is not arranged coaxially relative to the burner head 16 and may be, instead, positioned so that the burner fuel enters the pilot combustion space 22 at an angle relative to the axis 19. In this example, to ignite the fuel which is provided through the pilot fuel nozzle 30, the burner 10 has an electric igniter device 31 disposed within.

The air guiding device 14 of the illustrated example includes an air guiding tube 27 and a baffle plate 36 having cup-shaped design with a bottom wall 38 facing towards the base 34 and adjacent (e.g., against) an insulation shield 40. To improve the flow mechanics, in some examples, it is advantageous when additional baffle plates are positioned in this region. In this example, the insulation shield 40 is located between the base 34 and the bottom wall 38 and allows thermal decoupling (e.g., thermal isolation, etc.) of the base 34 from the air guiding device 14, the flame tube 12, the burner head 16 and/or the insert 24 from the pilot combustion space 22.

The base 34 of the illustrated example is designed to fasten the burner 10 to the pressure casing of a micro gas turbine. In this example, at the base 34, the air guiding device 14 is mounted in a spring elastic bearing with a plurality of spring struts 42 that pass through (e.g., penetrate) the insulation shield 40 and are each supported against a spring 46 located in a recess 44 of the base 34. The air guiding tube 27 may be displaced within the spring elastic bearing to compensate for thermal expansions, which may result from heating, relative to the base 34 in a general direction of the axis 19 of the burner head 16 depicted by a double arrow 50.

The burner head 16 and the insert 24 of the illustrated example are coupled to (e.g., fastened on) the base 34 by a plurality of retaining bolts 48 that pass through the insulation shield 40.

Figure 2:
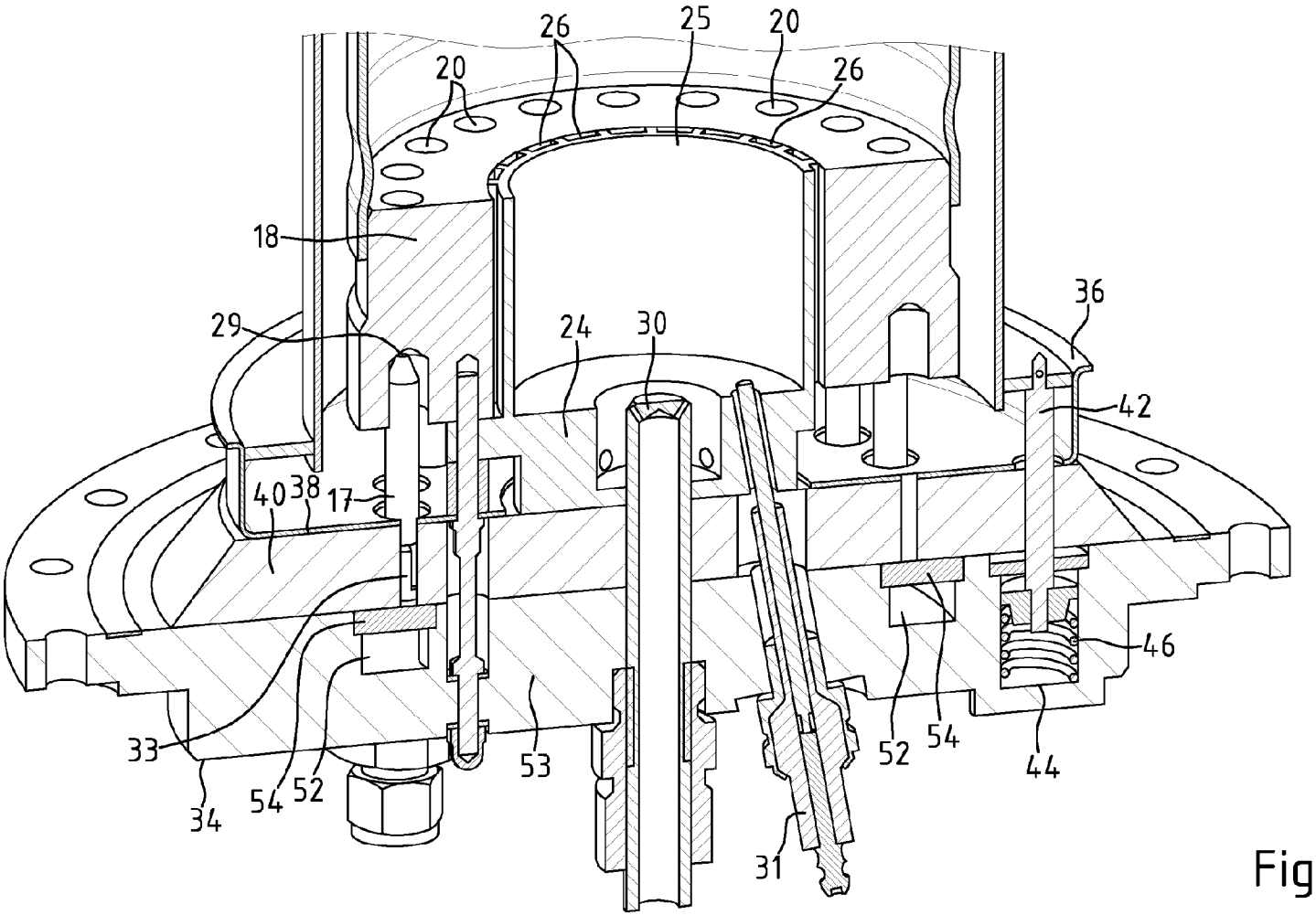
FIG. 2 illustrates a cross-sectional view of a portion of another example burner having fuel nozzles, a burner flange and a burner head.

FIG. 2 illustrates a portion of another example burner with the fuel nozzles 17 and the base 34. The fuel nozzles 17 of the illustrated example have a bore 29 that is designed as a core bore and acts as a channel for providing fuel into the combustion space 15. The fuel nozzles 17 of the illustrated example are mounted on the base 34 and pass through (e.g., penetrate) the insulation shield 40 and the bottom wall 38 of the baffle plate 36. In order to provide the fuel nozzles 17 with fuel, the base 34 has a fuel plenum. In this example, the fuel plenum is shaped as an annular passage 52 that fluidly communicates with the fuel nozzles 17. In this example, the annular passage 52 is closed. The annular passage 52 of the illustrated example is shaped generally as a circular groove formed in the base 34 and positioned on the combustion space side and covered by an annular cover element 54 fastened to the body 53 of the base 34 by screws and/or by welding, for example. The annular cover element 54 retains and/or couples to the fuel nozzles 17 in a nozzle seat 33, which projects into a through-bore 55 of the cover element 54. In this example, the fuel nozzles 17 are coupled to (e.g., fastened on) the annular cover element 54 by screws. The nozzle bore 29 of the fuel nozzles 17 is in fluid communication with the annular passage 52.

Figure 3:
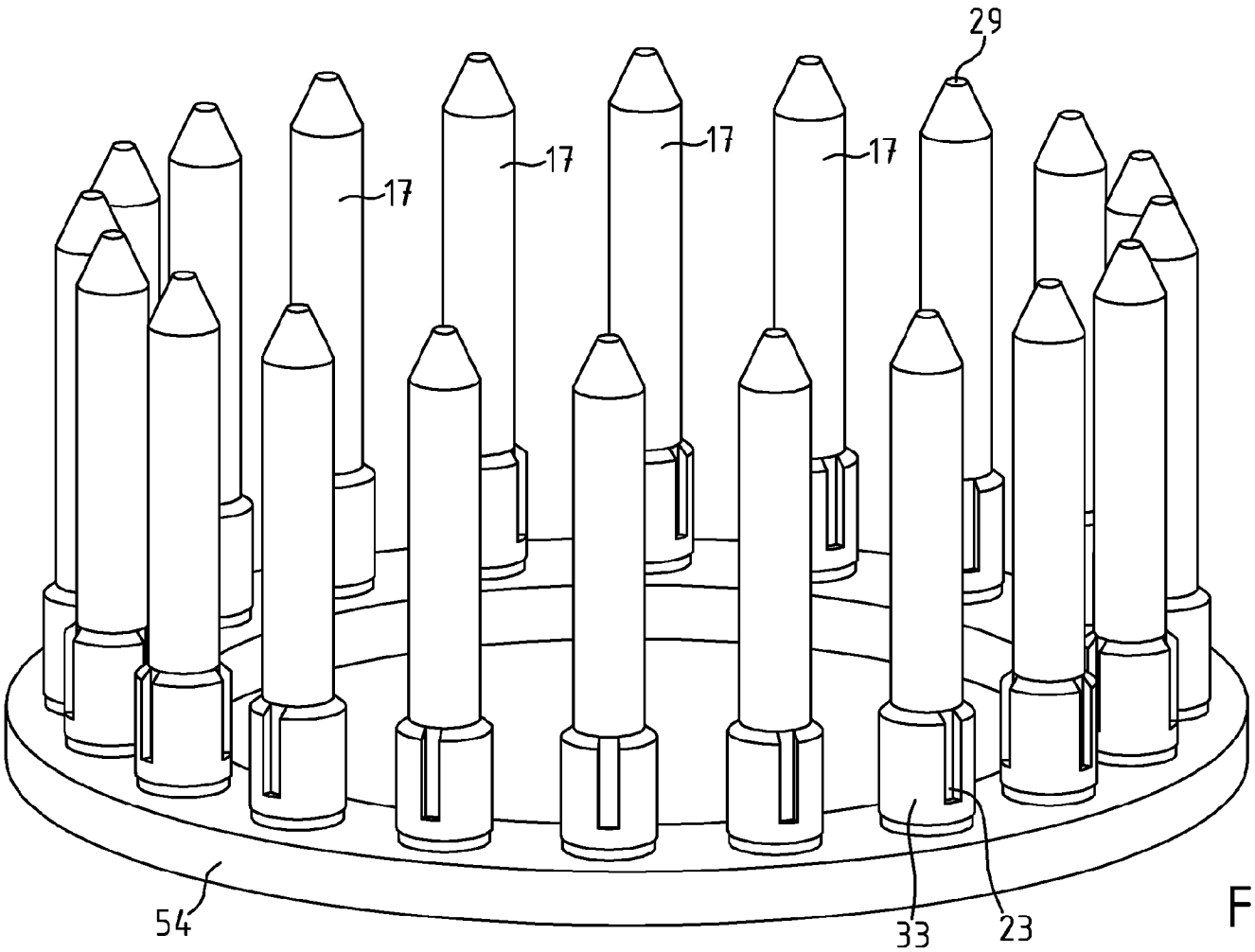
FIG. 3 illustrates an example mounting device to mount fuel nozzles of the example burner of FIG. 2.
Figure 4:
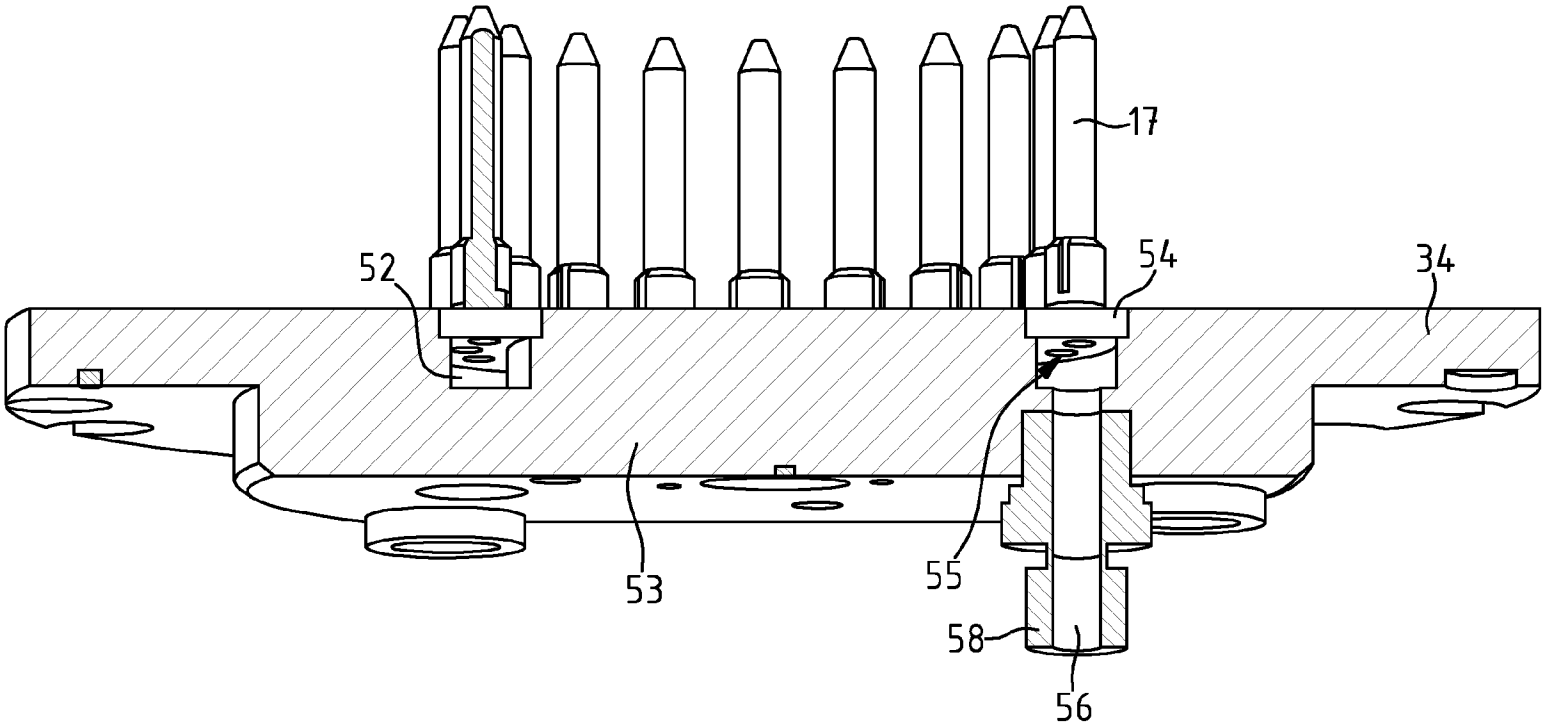
FIG. 4 illustrates the mounting device of FIG. 3 with a plurality of fuel nozzles in the burner flange.

FIG. 3 illustrates an example mounting device to mount fuel nozzles of the example burner of FIG. 2. The illustrated example of FIG. 3 depicts the fuel nozzles 17 with the annular cover element 54. FIG. 4 illustrates a partial view of the base 34 with a plurality of fuel nozzles 17. The fuel nozzles 17 of the illustrated example are produced, preferably, from temperature-resistant bar stock provided with the core bore, which enables production of the fuel nozzles 17 at a relatively low manufacturing cost. In this example, the fuel nozzles 17, which are in a portion face (e.g., pointing) towards the cover element 54, have a male thread 23 that is screwed onto the nozzle seat 33, which is fastened by welding to the cover element 54, for example. Such a measure may enable a relatively simple and quick exchange of fuel nozzles 17 in the burner 10. In some examples, the fuel nozzles 17 may also be coupled to the annular cover element 54 by welding.

The annular passage 52 in the base 34 of the burner 10 may be supplied with fuel through a feed passage 56, which may be fluidly coupled to a fuel line by a coupling element 58. The annular passage 52 of the illustrated example is a fuel distribution ring. In other examples, the annular passage may be shaped as a circular groove, and covered by the cover element on the side of the base 34 that generally faces away from the combustion space 15. In this example, it is not necessary to weld the cover element to the base because during burner operation, moderate temperatures usually occur in examples where conventional seals is possible (e.g., practical). The fuel that is distributed from the annular passage 52 to the nozzles 17 of the burner 10 may be liquid or gaseous form. In this example, the annular passage 52 is therefore a fuel plenum integrated into the base 34, which is shaped and/or formed as a burner flange (i.e., the annular passage acts as a fuel distributor accommodated in the body 53 of the base 34).

Figure 5:
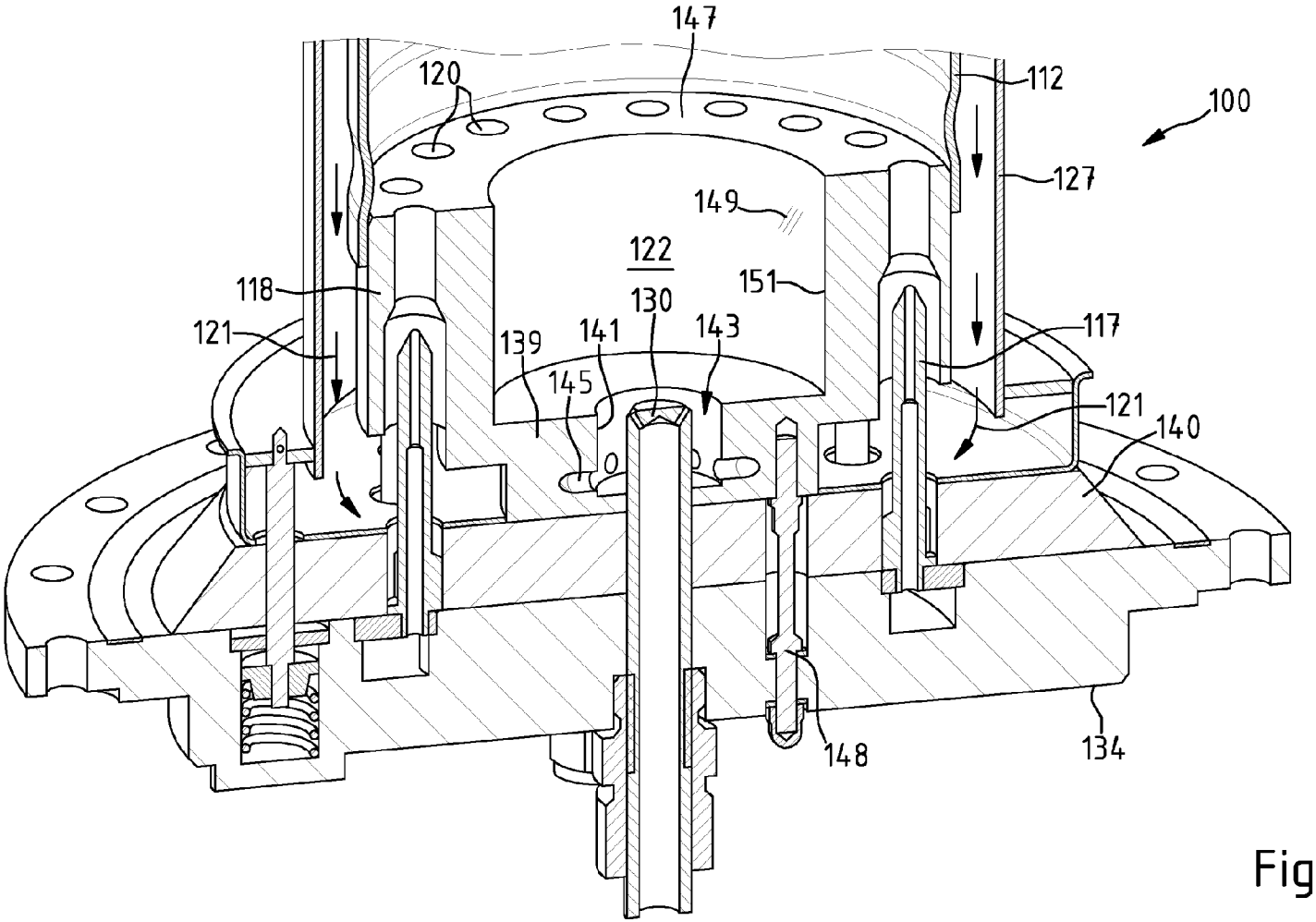
FIG. 5 illustrates a portion of another example burner having fuel nozzles, a burner flange and a burner head.

FIG. 5 shows a portion of another example burner 100 to produce heated gas having a flame tube 112 that may be connected to a turbine, which may have a similar construction the burner 10 described above in connection with FIGS. 1 to 4. In FIG. 5, the sub-assemblies of the burner 100, which are similar to the sub-assemblies of the burner 10, are identified with designations incremented by the number 100 with respect to FIGS. 1-4.

Unlike the example burner 10, the pilot combustion space 122 of the illustrated example is not defined by and/or formed in an insert. In some examples, the body 118 of the burner head 116 of the burner 100 is substantially cup-shaped, funnel-shaped and/or has a substantially rotationally symmetrical design. In this example, the body 118 has a bottom wall 139 with a bottom-side opening 141 for a pilot fuel nozzle 130 to project into a mixing chamber 143 formed in the body 118 and functioning as a premixing section. In this example, the body 118 of the burner head 116 has a plurality of air guiding passages 145 that are located (e.g., arranged) in the bottom wall 139 and extend outward from the mixing chamber 143, thereby acting as a premixing section. The air guiding passages 145 of the illustrated example are fluidly connected to the flow path 121 for air of the air guiding device 114. In this example, the air guiding passages 145 open into the mixing chamber 143, which acts as a premixing section.

As a result of air flowing in via the air guiding passages 145 in the mixing chamber 143, which acts as a premixing section, a swirled flow is formed in the mixing chamber 143. The body 118 of the burner head 116 has a portion with a preferably rotationally symmetrical pilot combustion-space wall 147 that encloses the pilot combustion space 122 and has a wall surface 151 to delimit the pilot combustion space 122. The wall surface 151 of the illustrated example is a defined surface of the pilot combustion space 122. In this example, a multiplicity of nozzle passages 120, each of which receive air from the air guiding device 114, are formed in the pilot combustion-space wall 147. A fuel nozzle 117 of the illustrated example is located in the nozzle passages 120. In some examples, the wall surface 151 of the burner-head body 118 that faces the pilot combustion space 122 is coated with a thermal protective coating 149.

As a result of the air flowing by the flow path 121 between the flame tube 112 and the air guiding tube 127, making its way via the air guiding passages 145 in the mixing chamber 143, acting as a premixing section, and moving through the nozzle passages 120 into the combustion space, the burner-head body 118 is cooled during operation of the burner 100. In this example, the fuel that discharges from the fuel nozzles 117 and flows through the fuel nozzles also cools the burner-head body 118. Because the cooling effect of the burner-head body 118 increases as wall thickness decreases, it is advantageous, in some examples, for the wall thickness of the pilot combustion-space wall 147 of the burner-head body 118 to be relatively thin (e.g., as thin as possible).

In summary, the following example is to be noted: A burner 10 for producing heated gas has a flame tube 12, which can be connected to a turbine. The burner includes an air guiding device 14 that encloses the flame tube 12 and has a flow path 21 for air. The burner has a burner head 16 fastened to a base 34. The burner head 16, for feeding fuel mixed with air into the flame tube 12, has a plurality of nozzle passages 20 that communicate with the flow path 21 for air in the air guiding device 14. A fuel nozzle 17, fastened on the base 34, projects into each of the nozzle passages 20. The fuel nozzles 17, for supplying with fuel, are connected to an annular passage 52 formed in the base 34 and may be connected to a fuel feed line.

It is the object of the examples disclosed herein to provide a burner for producing heated gas with a flame tube, which may be connected to a turbine, where the burner has a robust construction and may be inexpensively produced. Such an object may be achieved by means of a burner of the type referred to above, in which the fuel nozzles for supplying with fuel are connected to a fuel plenum formed on the base and may be connected to a fuel feed line.

The examples disclosed are based, in one aspect, on the principle that a burner, in which fuel nozzles do not penetrate the base but are connected to an annular passage formed in the base, may have a relatively simple and more cost-effective construction. Such a burner may be constructed with a reduced number of sealing faces and seals to enable the reduction of production costs. In order to supply the burner with fuel, there may be no need for a typical costly distribution system in which the fuel is distributed to different fuel nozzles. In comparison to conventional burners, a large number of hose and pipe connections, which sometimes have high assembly cost(s) and may give rise not only to safety problems but also to environmental problems, may be reduced and/or eliminated.

The fuel plenum may be generally shaped as an annular passage located in the base and/or formed in the base. The fuel plenum, in some examples, is preferably designed as a circular groove, and covered by a cover element on one side of the base. In such examples, the side of the base on which the circular groove is formed may face the combustion space or face away from the combustion space.

In some examples, the fuel nozzles are fastened and/or coupled to the burner by a mounting device that covers the annular passage. Such fuel nozzles are preferably welded or screwed onto the mounting device. A cost-effective production of the fuel nozzles is enabled by fuel nozzles being produced from preferably temperature-resistant bar stock provided with a core bore. By forming the base of the burner as a flanged part, it is possible to couple (e.g., fasten) the burner to the flanged part (e.g., on the pressure casing of a turbine).

In some examples, it is favorable for the burner head to have a body with a plurality of nozzle passages that fluidly communicate with the air guiding device and enclose a pilot combustion space open towards the flame tube and in fluid communication with the air guiding device. In this example, the air flow path is guided as far as possible, within certain sections, and along the burner head on a burner-head surface to cool the burner-head body via flowing air. The pilot combustion space may then be provided with fuel via a pilot fuel nozzle, which is associated with the pilot combustion space. In such examples, by feeding fuel through the pilot fuel nozzle, it is possible to ignite the burner via an igniter device. The resulting flame formed in the pilot combustion space also stabilizes the combustion in the burner. Additionally, by adjusting the flame produced in the pilot combustion space, it is possible to control or to regulate the burner and to stabilize the flame of the burner.

In some examples, the pilot combustion space is preferably formed in an insert, which is fastened to the base, and has a wall projecting into the burner head. In some examples, the pilot combustion-space wall may be cooled with air that flows through at least one flow passage in fluid communication with the air guiding device and positioned (e.g., formed) between the insert and the burner head.

Another aspect of the examples described herein is to cool the burner-head body with the air that flows through the nozzle passages. In some examples, for such cooling, it is advantageous for the burner-head body to have of a substantially cup, funnel shape, rotationally symmetric geometry and/or to provide a bottom wall with a bottom-side opening for a fuel nozzle that projects into the burner-head body. In some examples, it is also possible to provide fuel into the combustion space at the side or at an angle relative to a fuel nozzle that projects into the burner-head body. In such examples, it is advantageous if a plurality of air passages are formed in the bottom wall, which leads into the bottom-side opening of the bottom wall of the burner-head body, communicates with the air guiding device, and through which air can flow into the burner-head body to form a swirl-like flow in the pilot combustion space. According to the examples disclosed herein, the burner-head body may also include a wall that delimits the pilot combustion space and has a surface that acts as a combustion-space wall surface. The burner-head body in such examples is cooled with air which, via the flow paths for air, flows along the burner-head outer surface of the burner-head body and moves through the nozzle passages and into the combustion space.

In some examples, to reduce and/or minimize the thermal load of the burner head, it is favorable for the combustion-space wall surface of the pilot combustion space to be coated with a thermal protective coating. In some examples, the air guiding device preferably comprises an air guiding tube mounted onto the base in a spring elastic bearing and may be moved relative to the base to compensate for thermal expansion(s). With such a configuration, thermal stresses in the burner may be reduced and/or minimized. The spring elastic bearing may have a spring seated on the base and support a spring strut fastened to the air guiding tube. In these examples, it may be favorable for the air guiding tube on the spring strut in a portion facing the base to be displaced in a baffle plate that is cup-shaped and preferably has a rotationally symmetrical design that fits over the air guiding tube, and deflects air introduced via the air guiding tube into the nozzle passages to provide the burner with air in a relatively flow-optimized manner. To thermally decouple the base from the burner and the flame tube, it may be preferable for a thermal insulation coating to be provided between the baffle plate of cup-shaped design and the base.

The examples disclosed herein also extend to a method for producing heated gas with a burner that has a flame tube and a burner-head body and a combustion space positioned in the flame tube and a pilot combustion space enclosed by the burner-head body and open towards the combustion space. To produce heated gas with such a burner, air is provided and fuel is injected into the pilot combustion space. The fuel provided into the pilot combustion space is ignited. In other examples, air and fuel are fed into the combustion space as an air-fuel mixture, which is combusted in the combustion space.

In some examples, the air provided into the combustion space and the fuel provided into the combustion space are preferably provided into the combustion space in a swirl-free manner as a premixed (e.g., technically premixed) air-fuel mixture. It is especially one aspect of the examples disclosed herein to cool the burner-head body with the air which is fed into the combustion space.

As set forth herein, an example burner (10) for producing heated gas includes a flame tube (12), which may be connected to a turbine, is arranged in an air guiding device (14) that encloses the flame tube (12) and in which is formed a flow path (21) for air, and a burner head (16) fastened to a base (34) and which for feeding fuel mixed with air into the flame tube (12) has a plurality of nozzle passages (20) which communicate with the flow path (21) for air in the air guiding device (14) and into which projects in each case a fuel nozzle (17), which is fastened on a base (34), where the fuel nozzles (17), for supplying fuel, are connected to fuel plenum that is formed in the base (34) and can be connected to a fuel feed line, where the burner head (16) has a body (18) in which the nozzle passages (20) are formed and communicate with the flow path (21) for air in the air guiding device (14), which burner-head body encloses a pilot combustion space (22) that is open towards the flame tube (12) and communicates with the air guiding device (14).

In some examples, the pilot combustion space (22) is formed in an insert (24), fastened on the base (34), and has a wall (25) that projects into the burner-head body (18) and can be cooled with air that flows through at least one fluid passage (26), which communicates with the flow path (21) for air in the air guiding device (14) and is formed between the insert (24) and the burner head (16). In some examples, the fuel plenum is designed as an annular passage (52) positioned in the base (34). In some examples, the fuel nozzles (17) are fastened on a mounting device (54) which covers the fuel plenum.

In some examples, the fuel nozzles (17) are connected, especially welded or screwed, to the mounting device (54). In some examples, the fuel nozzles (17) are produced from temperature-resistant bar stock provided with a core bore. In some examples, the base (34) is designed as a flanged part for fastening the burner (10) in a pressure casing. In some examples, the flow path (21) for air is guided, at least in certain sections, along the burner head (16) on a burner-head outer surface to cooling the burner-head body (18) by means of flowing air.

In some examples, the pilot combustion space (22) may be supplied with fuel via a pilot fuel nozzle (30). In some examples, the burner-head body (118) has a substantially cup-shaped design and has a bottom wall (138) with a bottom-side opening for a pilot fuel nozzle (130) that projects into the burner-head body and in which are formed a plurality of air guiding passages (145), which extend into the bottom wall (138), open into the bottom-side opening (141) and communicate with the air guiding device (114), and where the burner-head body (118) has a portion with a pilot combustion-space wall (147) that encloses the pilot combustion space (122) and has a wall surface (151) delimiting the pilot combustion space (122).

In some examples, the nozzle passages (120) that communicate with the flow path (121) for air in the air guiding device (114) are formed in the pilot combustion-space wall (147). In some examples, the wall surface (151) for the pilot combustion space (122) is coated with a thermal protective coating. In some examples, the air guiding device (14) comprises an air guiding tube (27) supported on the base (34) by a spring-elastic bearing and can be moved relative to the base (34) to compensate for thermal expansion.

In some examples, the spring-elastic bearing has a spring (46) that is seated on the base (34) and supported on a spring strut (42) fastened to the air guiding tube (27). In some examples, the air guiding tube (27) is displaced on the spring strut (42) by a portion facing the base (34) in a baffle plate (36) that preferably has a substantially cup-shaped design, fits over the air guiding tube (27) and is fastened to the base (34). In this example, the baffle plate (36) deflects the air that is provided through the air guiding tube (27) into the nozzle passages (20).

In some examples, a provision is made between the baffle plate (36) and the base (34) for an insulation shield (40) that thermally decouples the baffle plate (36), the air guiding device (14) and the flame tube (12) from the base (34). In some examples, a gas turbine plant includes a gas turbine with an air guiding device in which is arranged a flame tube (12, 112) of a burner of any of the examples disclosed herein.

An example method for producing heated gas includes providing a burner (10, 100) with a flame tube (12, 112) and a burner-head body (18, 118), which has a combustion space (15), arranged in the flame tube (12, 112), and a pilot combustion space (22, 122), which is enclosed by the burner-head body (18, 118) and open towards the combustion space (15), feeding air and injecting fuel into the pilot combustion space (22, 122), igniting the fuel provided into the pilot combustion space (22, 122), feeding air and fuel into the combustion space (15) as an air-fuel mixture, and combusting the air-fuel mixture in the combustion space (15), where the burner-head body (18, 118) is cooled with the air provided into the combustion space (15).

In some examples, the air provided into the combustion space (15) and the fuel which is fed into the combustion space (15) is provided into the combustion space (15) in a relatively swirl-free manner as a premixed (e.g., technically premixed) air-fuel mixture.

In some examples, the burner-head body (18, 118) is cooled via air that flows via flow paths along the outer surface of the burner-head body (18, 118) and moves into the combustion space (15) through nozzle passages (20, 120) formed in the burner-head body (18, 118). In some examples, the pilot combustion space (22, 122) is provided in an insert (24), fastened on a base, which has a wall (25) which projects into a burner head (16) and is cooled by air that flows through at least one flow passage (26) formed between the insert (24) and the burner head (16).

One example apparatus includes a base of a burner comprising a fuel plenum, where the base comprises a fuel plenum and is coupled to fuel nozzles, and where at least one of the fuel nozzles is in fluid communication with the fuel plenum. The example apparatus also includes a burner head of the burner comprising nozzle passages in fluid communication with an airflow path, where the burner head defines a pilot combustion space that opens towards a flame tube of the burner, and is in fluid communication with the airflow path, and where each nozzle passage is to receive a fuel nozzle to provide fuel to entrain with air from the airflow path. In some examples, the airflow path is defined by a flame tube of the burner. In some examples, the fuel nozzles are integral with the base.

One example burner (10) to produce heated gas includes a flame tube (12) that can be connected to a turbine and is positioned in an air guiding device (14) that encloses the flame tube (12) and in which is formed a flow path (21) for air, and with a burner head (16) fastened on a base (34) to feed fuel mixed with air into the flame tube (12) has a plurality of nozzle passages (20) that communicate with the flow path (21) for air in the air guiding device (14) and into which projects a fuel nozzle (17) fastened on a base (34), where the fuel nozzles (17), for supplying with fuel, are connected to fuel plenum which is formed in the base (34) and which can be connected to a fuel feed line.

In some examples, the fuel plenum is shaped as an annular passage (52) located in the base (34). In some examples, the fuel nozzles (17) are fastened on a mounting device (54) that covers the fuel plenum. In some examples, the fuel nozzles (17) are connected, especially welded or screwed, to the mounting device (54). In some examples, the fuel nozzles (17) are produced from temperature-resistant bar stock provided with a core bore.

In some examples, the base (34) is designed as a flanged part for fastening the burner (10) in a pressure casing. In some examples, the burner head (16) has a body (18) in which the nozzle passages (20) are formed and communicate with the flow path (21) for air in the air guiding device (14), which burner-head body encloses a pilot combustion space (22) that is open towards the flame tube (12) and communicates with the air guiding device (14). In some examples, the flow path (21) for air is guided, at least in certain sections, along the burner head (16) on a burner-head outer surface to cool the burner-head body (18) by means of flowing air. In some examples, the pilot combustion space (22) is provided with fuel via a pilot fuel nozzle (30).

In some examples, the pilot combustion space (22) is formed in an insert (24), fastened on the base (34), and has a wall (25) that projects into the burner-head body (18) and can be cooled with air which flows through at least one fluid passage (26), which communicates with the flow path (21) for air in the air guiding device (14) and is formed between the insert (24) and the burner head (16).

One example burner (100) to produce heated gas includes a flame tube (112) that may be connected to a turbine and is located in an air guiding device (114) that encloses the flame tube (112) and in which a flow path (121) for air is formed, and a burner head (116) which is fastened on a base (134) and which for feeding fuel mixed with air into the flame tube (112), has a plurality of nozzle passages (120) that communicate with the flow path (121) for air in the air guiding device (114) and in which is located a fuel nozzle (117) which is fastened on the base (134), especially as described in any of the examples disclosed herein, where the burner head (116) has a burner-head body (118) in which are formed the nozzle passages (120) that communicate with the flow path (121) for air in the air guiding device (114), which burner-head body (118) encloses a pilot combustion space (122) that is open towards the flame tube (112) and communicates with the air guiding device (114), where the burner-head body (118) has a cup-shaped design and a bottom wall (138) with a bottom-side opening for a pilot fuel nozzle (130) to project into the burner-head body and in which are formed a plurality of air guiding passages (145) that extend in the bottom wall (138), open into the bottom-side opening (141) and fluidly communicate with the air guiding device (114), and wherein the burner-head body (118) has a portion with a pilot combustion-space wall (147) that encloses the pilot combustion space (122) and a wall surface (151) delimiting the pilot combustion space (122).

In some examples, the nozzle passages (120) that communicate with the flow path (121) for air in the air guiding device (114) are formed in the pilot combustion-space wall (147). In some examples, the wall surface (151) for the pilot combustion space (122) is covered with a thermal protective coating. In some examples, the air guiding device (14) comprises an air guiding tube (27) that is supported on the base (34) in a spring-elastic bearing and can be moved relative to the base (34) to compensate for thermal expansion. In some examples, the spring-elastic bearing has a spring (46) seated on the base (34) and supported on a spring strut (42) fastened on the air guiding tube (27).

In some examples, where the air guiding tube (27) may be displaced on the spring strut (42) by a portion facing the base (34) in a baffle plate (36), preferably of cup-shaped design, which fits over the air guiding tube (27) and is fastened to the base (34), where the baffle plate (36) deflects the air, which is fed through the air guiding tube (27), into the nozzle passages (20). In some examples, a provision is made between the baffle plate (36) and the base (34) for an insulation shield (40) that thermally decouples the baffle plate (36), the air guiding device (14) and the flame tube (12) from the base (34).

One example gas turbine plant comprises a gas turbine with an air guiding device in which is arranged a flame tube (12, 112) of a burner in accordance with the teachings of this disclosure.

An example method for producing heated gas includes providing a burner (10, 100) with a flame tube (12, 112) and a burner-head body (18, 118), which has a combustion space (15), arranged in the flame tube (12, 112), and a pilot combustion space (22, 122), which is enclosed by the burner-head body (18, 118) and is open towards the combustion space (15), providing air and injecting fuel into the pilot combustion space (22, 122), igniting the fuel that is fed into the pilot combustion space (22, 122), providing air and fuel into the combustion space (15) as an air-fuel mixture, and combusting the air-fuel mixture in the combustion space (15).

In some examples, the air and the fuel are provided into the combustion space (15) in a relatively swirl-free manner as a premixed (e.g., technically premixed) air-fuel mixture. In some examples, the burner-head body (18, 118) is cooled with the air fed into the combustion space (15).

This patent arises as a continuation-in-part of International Patent Application No. PCT/EP2013/066943, which was filed on Aug. 13, 2013, which claims priority to German Patent Application No. 10 2012 216 080, which was filed on Sep. 11, 2012, which claims priority to German Patent Application No. 10 2012 214 707, which was filed on Aug. 17, 2012. The foregoing International Patent Application and the German Patent Applications are hereby incorporated herein by reference in their entireties.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A burner to produce heated gas, comprising:

a flame tube located in an air guiding device that encloses the flame tube and defines an airflow path; and a burner head coupled to a base, the burner head comprising a burner-head body, the burner-head body having a plurality of nozzle passages that fluidly communicate with the airflow path, wherein a fuel nozzle of a plurality of fuel nozzles projects into each nozzle passage to provide fuel mixed with air from the airflow path into the flame tube, wherein each fuel nozzle is fastened to the base and fluidly coupled to a fuel plenum formed in the base, wherein the burner-head body encloses a pilot combustion space that is open towards the flame tube and is in fluid communication with the air guiding device, the burner-head body has a substantially cup-shaped design with a bottom wall and a pilot combustion-space wall to enclose the pilot combustion space, wherein the bottom wall has a bottom-side opening for a pilot fuel nozzle that projects into the burner-head body a plurality of air guiding passages which extend into the bottom wall, open into and has the bottom-side opening and are in fluid communication with the air guiding device, and wherein the pilot combustion-space wall has a wall surface delimiting the pilot combustion space, and wherein the nozzle passages that communicate with the airflow path in the air guiding device are formed in the pilot combustion-space wall.

2. The burner as defined in claim 1, wherein the pilot combustion space is formed in an insert, the insert fastened on the base, the insert including a wall which projects into the burner-head body and is cooled with air that flows through at least one fluid passage that is in fluid communication with the airflow path and located between the insert and the burner head.

3. The burner as defined in claim 1, wherein the fuel plenum is an annular passage of the base.

4. The burner as defined in claim 1, wherein the fuel nozzles are fastened to a mounting device that covers the fuel plenum.

5. The burner as claimed in claim 4, wherein the fuel nozzles are welded or screwed onto the mounting device.

6. The burner as defined in claim 1, wherein the fuel nozzles are produced from temperature-resistant bar stock provided with a core bore.

7. The burner as defined in claim 1, wherein the base is shaped as a flanged part to fasten the burner in a pressure casing.

8. The burner as defined in claim 1, wherein airflow is guided along at least a portion of the burner head on a burner-head outer surface to cool the burner-head body.

9. The burner as defined in claim 1, wherein the pilot combustion space is provided with fuel via a pilot fuel nozzle.

10. The burner as defined in claim 1, wherein the wall surface for the pilot combustion space is coated with a thermal protective coating.

11. The burner as defined in claim 1, wherein the air guiding device comprises an air guiding tube supported by a spring-elastic bearing of the base and is movable relative to the base to compensate for thermal expansion.

12. The burner as defined in claim 11, wherein the spring-elastic bearing has a spring seated on the base and is supported by a spring strut fastened to the air guiding tube.

13. A gas turbine plant including the burner as defined in claim 1.

14. A burner to produce heated gas, comprising:

a flame tube located in an air guiding device that encloses the flame tube and defines an airflow path; and a burner head coupled to a base and comprising a burner-head body, the burner-head body having a plurality of nozzle passages that fluidly communicate with the airflow path, wherein a fuel nozzle of a plurality of fuel nozzles projects into each nozzle passage to provide fuel mixed with air from the airflow path into the flame tube, wherein each fuel nozzle is fastened to the base and fluidly coupled to a fuel plenum formed in the base, wherein the burner-head body encloses a pilot combustion space that is open towards the flame tube and is in fluid communication with the air guiding device, wherein the air guiding device comprises an air guiding tube supported by a spring-elastic bearing of the base and is movable relative to the base to compensate for thermal expansion, wherein the spring-elastic bearing has a spring seated on the base and is supported by a spring strut fastened to the air guiding tube, wherein the air guiding tube is movable relative to a baffle plate by a radially extending flange of the spring strut that is coupled to the air guiding tube, wherein the baffle plate is cup-shaped and fits over the air guiding tube, wherein the baffle plate fastened to the base, and wherein the baffle plate deflects the air from the air guiding tube into the nozzle passages.

15. The burner as defined in claim 14, further comprising an insulation shield between the baffle plate and the base to thermally decouple the baffle plate, the air guiding device and the flame tube from the base.

16. A burner comprising:

a flame tube defining a combustion chamber and having a longitudinal axis;

a substantially flat base that is arranged at an end of the flame tube; the base including an insulation shield;

a plurality of fuel nozzles and a pilot fuel nozzle, wherein the plurality of fuel nozzles and the pilot fuel nozzle extend from the base; and a burner-head axially offset from the base and extending from the base to fit within the flame tube, wherein the burner-head comprises an annular wall which radially encloses a pilot combustion space and a lower wall that is proximate the base, wherein the burner-head is proximate the annular wall and forms an axial boundary of the pilot combustion space, the annular wall including axially arranged nozzle passages that extend substantially parallel to the longitudinal axis, wherein each one of the nozzle passages receives a respective fuel nozzle of the plurality of fuel nozzles, the lower wall including air passages that are radially oriented, and include air inlets at a radially outer surface of the lower wall and air outlets that supply air to a mixing chamber formed in the lower wall, the pilot nozzle extending into the mixing chamber, wherein each one of the nozzle passages is sized so that air flows through nozzle passage inlets and around the respective fuel nozzle to mix with fuel from the nozzle and create an air fuel mixture, the fuel nozzle passages configured to provide the air fuel mixture downstream of the pilot combustion space and into the flame tube.

17. The burner as defined in claim 16, further including a fuel plenum that is an annular passage of the base.

18. The burner as defined in claim 16, wherein the pilot combustion space is formed in an insert, the insert fastened on the base, the insert including a wall which projects into the burner-head and is cooled with air that flows through at least one fluid passage that is in fluid communication with an airflow path and located between the insert and the burner head.

19. The burner as defined in claim 18, wherein the fuel nozzles are each fastened to a mounting device that covers the fuel plenum.

20. The burner as claimed in claim 17 wherein the fuel nozzles are welded or screwed onto the mounting device.

21. The burner as defined in claim 16, wherein the fuel nozzles are produced from temperature-resistant bar stock provided with a core bore.

22. The burner as defined in claim 16, wherein the base is shaped as a flanged part to fasten the burner in a pressure casing.

23. The burner as defined in claim 16, wherein airflow is guided along at least a portion of the burner head on a burner-head outer surface to cool the burner head.

24. The burner as defined in claim 16, wherein a wall surface for delimiting the pilot combustion space is coated with a thermal protective coating.

25. The burner as defined in claim 16, wherein the air passages are in fluid communication with an air guiding device, and wherein the air guiding device includes an air guiding tube supported by a spring-elastic bearing of the base and is movable relative to the base to compensate for thermal expansion.

26. The burner as defined in claim 25, wherein the air guiding tube is movable relative to a baffle plate by a radially extending flange of a spring strut that is coupled to the air guiding tube, wherein the baffle plate is cup-shaped and fits over the air guiding tube, wherein the baffle plate is fastened to the base, and wherein the baffle plate deflects the air from the air guiding tube into the nozzle passages.

27. The burner as defined in claim 26, further including an insulation shield between the baffle plate and the base to thermally decouple the baffle plate, the air guiding device and the flame tube from the base.

28. A gas turbine plant including the burner as defined in claim 16.

* * * * *